US009925810B2

(12) United States Patent
Kalloe et al.

(10) Patent No.: US 9,925,810 B2
(45) Date of Patent: Mar. 27, 2018

(54) METHOD FOR APPROVING A NEW PRINT MEDIUM FOR USE IN A PRINT SYSTEM

(71) Applicant: Océ-Technologies B.V., Venlo (NL)

(72) Inventors: Vijay A. Kalloe, Venlo (NL); Jeroen P. J. Huijbers, Venlo (NL); Ronnie J. H. G. Berghs, Venlo (NL); Wilhelmus M. Van Herpen, Venlo (NL)

(73) Assignee: OCÉ-TECHNOLOGIES B.V., Venlo (NL)

( * ) Notice: Subject to any disclaimer, the term of this patent is extended or adjusted under 35 U.S.C. 154(b) by 0 days.

(21) Appl. No.: 15/337,680

(22) Filed: Oct. 28, 2016

(65) Prior Publication Data

US 2017/0120646 A1 May 4, 2017

(30) Foreign Application Priority Data

Oct. 30, 2015 (EP) ..... 15192263
Nov. 25, 2015 (EP) ..... 15196252

(51) Int. Cl.

*B41J 11/00* (2006.01)
*G03G 5/05* (2006.01)
*B41J 29/38* (2006.01)
*G03G 15/00* (2006.01)

(52) U.S. Cl.

CPC ..... *B41J 29/38* (2013.01); *G03G 15/50* (2013.01)

(58) Field of Classification Search

CPC ..... G03G 15/553; G03G 15/5401; G03G 15/5058; G03G 15/50

See application file for complete search history.

(56) References Cited

U.S. PATENT DOCUMENTS 5,250,988 A * 10/1993 Matsuura ..... G03G 15/5041 347/116
5,717,976 A * 2/1998 Chowdry ..... B65H 43/00 270/58.01
6,335,084 B1 * 1/2002 Biegelsen ..... G06K 7/10722 283/36
6,604,875 B2 * 8/2003 Meunier ..... G06K 19/06028 400/103
7,050,196 B1 5/2006 Piatt et al.

(Continued)

FOREIGN PATENT DOCUMENTS

WO WO 2007/050055 A1 5/2007

*Primary Examiner* — Patrick King

(74) *Attorney, Agent, or Firm* — Birch, Stewart, Kolasch & Birch, LLP

(57) ABSTRACT

A system and method for adding a print medium digitally to a print system are disclosed. The print system has a control unit for controlling a print job queue and print system parameters, a print engine, an input section, and a receiving section. The method includes receiving the print medium in the input section, loading a test job having prescribed print system parameters in the receiving section, printing a large number of prints of the test job to establish an unwanted deposit of marking material on the side of the stack, and establishing whether or not an unwanted marking material is deposited on a stack height side of the stack. If unwanted deposit is established, then printing a number of blank sheets of the same print medium, adjusting the print system parameters, and returning to printing. If no unwanted deposit is established, approving the use of the print medium.

9 Claims, 7 Drawing Sheets

(56) References Cited

U.S. PATENT DOCUMENTS

| | | | | |
|---|---|---|---|---|
| 7,885,597 | B2 * | 2/2011 | Gast | H04N 1/00567 271/162 |
| 2002/0134130 | A1 | 9/2002 | Johnson | |
| 2003/0095811 | A1 * | 5/2003 | Haines | B41J 11/009 399/84 |
| 2004/0160593 | A1 | 8/2004 | Rolon et al. | |
| 2005/0036799 | A1 * | 2/2005 | Tomita | G03G 15/50 399/49 |
| 2005/0230051 | A1 * | 10/2005 | Yamamoto | B41J 3/4075 156/361 |
| 2006/0044334 | A1 * | 3/2006 | Fujita | B41J 2/2135 347/12 |
| 2008/0053327 | A1 * | 3/2008 | Weilacher | G03G 15/5062 101/484 |
| 2008/0094645 | A1 * | 4/2008 | Sato | G03G 15/5062 358/1.1 |
| 2009/0317122 | A1 * | 12/2009 | Takahashi | G03G 15/50 399/82 |
| 2014/0037354 | A1 * | 2/2014 | Araki | B41J 2/07 400/76 |
| 2014/0168307 | A1 | 6/2014 | Silveston-Keith et al. | |
| 2015/0070732 | A1 * | 3/2015 | Kishi | G03G 15/5062 358/3.27 |

* cited by examiner

METHOD FOR APPROVING A NEW PRINT MEDIUM FOR USE IN A PRINT SYSTEM

CROSS-REFERENCE TO RELATED APPLICATIONS

This application claims priority under 35 U.S.C. § 119(a) to Application Nos. 15192263.0 and 15196252.9, filed in Europe on Oct. 30, 2015 and Nov. 25, 2015, respectively. The entire contents of all of the above-identified applications are hereby incorporated by reference into the present application.

BACKGROUND OF THE INVENTION

1. Field of the Invention

The present invention relates to a method for adding a print medium digitally to a print system, the print system is configured to print on approved print media and comprises a control unit for controlling print system parameters to be applied when printing on the print medium, a print engine for printing marking material on the print medium, an input section for receiving the print medium in the print system, and a receiving section for receiving print jobs submitted to the print system.

The method comprises the steps of a) receiving the print medium in the input section, and b) loading a test job in the receiving section, the test job comprises, as a print job property, the print medium with prescribed print system parameters.

2. Description of the Background Art

To run a certain print medium on a print system, the print system needs to use prescribed print system parameters. For a cut sheet inkjet printer, important values include a total area coverage (TAC), i.e. an amount of marking material that can be placed on the print medium, a distance from the print head to the print medium, and a color profile to be applied. A TAC that is too high for the print medium may result in marking material deposition inside the print engine, as pollution or smearing, and when printed for a longer time, will result in damage to the print engine. Other print system parameters influence the print quality and the amount of sheets that are rejected by the print system due to deformation of the sheets.

In U.S. Pat. No. 7,050,196 B1, a method is revealed to print a test sheet to visually determine a maximal ink coverage. However, marking material deposition inside the print engine is not detected.

As determining values for print system parameters that result in optimal print quality and runnability requires printing a significant amount of print media, time, and specialized hardware, a user of the print system can currently choose print media that has been pre-tested by a supplier of the print media, and from which media definitions has been made available.

An object of the present invention is to provide a method for users that want to use their own print medium, and do not want to wait for the supplier, to test the print medium. Another object is to provide a method to find print system parameters that are adequate for a customer's usage, and will not result in damage to the print engine. Another object of the present invention is a print system in which the method is implemented.

SUMMARY OF THE INVENTION

For this purpose, a method according to the invention comprises the steps of c) printing a large number of prints of the test job such that a stack of the number of prints is sufficiently high to establish an unwanted deposit of marking material on the side of the stack, d) establishing whether or not an unwanted marking material is deposited on a stack height side of the stack, by operator observation or by an automated scanning system for checking for pollution of the stack height side of the stack and e) if an unwanted deposit of marking material is established on the stack height side, printing a number of blank sheets of the same print medium, adjusting the print system parameters and returning to step c), and f) if no unwanted deposit of marking material is established on the stack height side, approving the use of the print medium in the print system for print jobs having the print medium as a print job property.

The method may be implemented in the control unit of the print system or in an external software tool, which supports the execution of the steps of the method. The prescribed print system parameters may comprise the TAC, a color profile and a print head height. By printing the test job on a large number of prints—for example approximately 125 sheets of a test chart of a single full page color patch, or a sheet stack having a height of approximately at least 1 cm—pollution in the form of unwanted deposit of marking material on the side of the stack is readily detectable. The inventors have observed that a degree of unwanted deposit of marking material on the side of the stack is a measure for the pollution inside the print engine.

If stack pollution is observed, the user may register "stack pollution" using the user interface of the print system. Subsequently, the print system may be activated—automatically or manually—to print a number of blank sheets of the print medium, to clean the print engine, and the user adjusts the values of the print system parameters, using the user interface of the print system, and makes more prints of the test job until a stack without pollution is observed. The adjusting of the print system parameters may for example include decreasing the TAC value, or adjusting the gap distance between the print head and the print medium. A quality acceptable to the user may be reached quickly if the print medium does not have print medium properties that are too extreme.

According to an embodiment, the method comprises the steps of g) printing at least one print of a second test job, the second test job is designed to test an image quality of a print of the test job, h) receiving a test result of the at least one print printed in step g), and i) if the image quality of the test result is sufficient, proceeding with step c), j) if the image quality of the test result is not sufficient, adjusting print system parameters and returning to step g), wherein the steps g)-j) are performed after step b), and before step c). By doing so, firstly, the new print medium is tested on a user selected print job with default settings, and the user may decide if the image quality is sufficient. Secondly, it is verified that the engine will not become damaged by printing a stack of test charts, according to the steps c)-f), that help determine robustness.

According to an embodiment, the print system comprises a print medium catalogue for print media to be used in the print system, and the step of approving the use of the tested print medium comprises the steps of k) creating a new entry in the print medium catalogue for the tested print medium, l) adding properties of the tested print medium to the entry, and m) adding the adjusted print system parameters to the entry.

Once the user does not observe stack pollution, he may enter additional metadata of the print medium, such as name and type, and the print medium is digitally added to the print system, for example by adding the print medium properties and metadata to the digital media catalogue of the print system. By doing so, the use of the print medium in the print system is approved for print jobs having the print medium as a print job property.

According to a further embodiment, the method comprising the steps of n) creating a first media catalogue entry for the print medium with properties of the medium and with default print system parameters, o) creating a second media catalogue entry for the print medium for testing the test job in which the print medium is used with prescribed print system parameters, p) adjusting the print system parameters in the second media catalogue entry due to step e), q) approving the print medium by adding properties of the print medium to the second media catalogue entry, by replacing the first media catalogue entry by the second media catalogue entry, and by removing the second media catalogue entry from the media catalogue.

According to an embodiment of the method, the print system parameters comprise at least one of a total area coverage value, a print gap minimum distance, a print gap maximum distance, a color profile, a print speed, a dot size, a print head transition setting, a nozzle failure correction setting, a fixation setting, a drying setting, a paper handling setting, and a halftoning raster setting. The print head transition setting is a setting for a multiple print head assembly, which is dependent of the used print medium, and determines which inkjet dot pattern is deposited on a transition area between two print heads jetting a same ink color. An appropriate print head transition setting prevents an image to image interaction.

According to an embodiment, before approving the use of the print medium in the print system, the method comprises the step of loading blank sheets of the print medium upside down in the input section and repeating the steps c)-f). This is advantageous because properties of the print medium may differ between sides of sheet of the print medium, and may result in a difference in print quality performance between a front side and a back side of a sheet of the print medium.

According to an embodiment, the step of approving the use of the print medium in the print system comprises the step of performing a standard media family calibration for the print medium to be approved. Such a standard media family calibration is also known as a linearization of color of the print medium.

The present invention also relates to a print system configured to print on approved print media, and comprising a control unit for controlling print system parameters to be applied when printing on the print medium, a print engine for printing marking material on the print medium, an input section for receiving the print medium in the print system, and a receiving section for receiving print jobs submitted to the print system, wherein the control unit is configured to execute a method according to the invention.

The present invention also relates to a recording medium comprising computer executable program code configured to instruct a computer to perform a method according to the invention. Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE PREFERRED EMBODIMENTS

Figure 1:
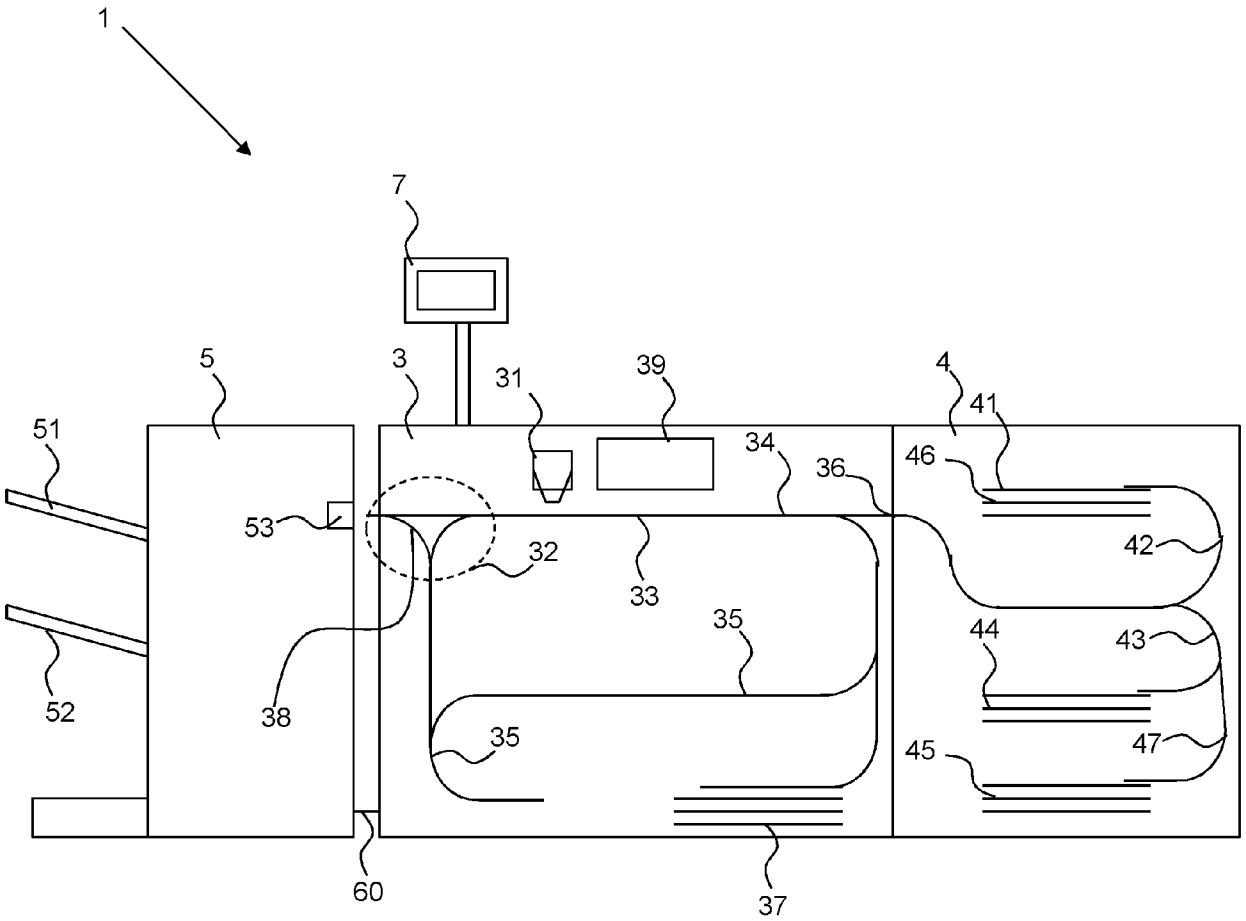
FIG. 1 shows the general arrangement of the printing system according to the invention.

The present invention will now be described with reference to the accompanying drawings, wherein the same or similar elements are identified with the same reference numerals throughout the several views.

The embodiments are explained by taking in the examples a printing system comprising a print head or print assembly, like an inkjet printing system or an electro-photographical printing system. In principal a printing system in which any kind of print medium, any kind of marking material, and, if needed, any kind of finishing material is to be loaded and the kind of marking material is to be printed on the kind of print medium may be configured to use the methods according to the embodiments of the present invention.

FIG. 1 shows schematically an exemplary printing system 1 in which the method according to the invention is applicable. The printing system 1 comprises an output section 5, a print engine and control section 3 possibly containing one or more input sections 37, a local user interface 7 and an input section 4.

The output section 5 comprises two supply material output holders 51, 52 for holding printed print medium. The printed print medium is transported from the print engine and control section 3 via an inlet 53 to the output section 5. The output section 5 is digitally connected by means of a cable 60 to the print engine and control section 3 for bi-directional data signal transfer. Other supply material output holders may be envisioned, for example a supply material output holder for residuals of ink, or toner, or a supply material output holder for waste paper, in case of drilling actions, cutting actions, or perforating actions. Depletions of such a supply material output holder may be scheduled according to the method of the invention.

The print engine and control section 3 comprise a print engine and a control unit 39 for controlling the printing process. The control unit 39 is a computer or server or a workstation, connected to the print engine, and connected to the digital environment of the printing system, for example a network for transmitting a submitted print job to the printing system. The control unit 39 also comprises, in storage, a media catalogue software system (not shown) for print media approved for use by the printing system 1. The control unit 39 also comprises the receiving section (not shown) for receiving print jobs submitted to the printing system 1.

The print engine comprises a print head or print assembly 31 for ejecting or fixing marking material to the print medium, and a paper path 32, 33, 34, 35 for transporting the print medium from an entry point 36 of the print engine and control section 3 to the inlet 53 of the output section 5. The print head or print assembly 31 is positioned near the paper path section 34. While a print medium is transported along the paper path section 34, the print medium receives the marking material from the print head or print assembly 31. A next paper path section 32 is a flip unit for selecting a different subsequent paper path for simplex or duplex printing of the print medium. The flip unit 32 may be also used to flip a printed sheet of print medium after printing in simplex mode, before the printed sheet leaves the print engine and control section 3 via a curved section 38 of the flip unit 32 and via the inlet 53 to the output section 5. In another embodiment of the printing system, the curved section 38 of the flip unit 32 is not present, and the turning of a simplex page has to be done via another paper path section 35, and leads to productivity loss. In another embodiment of the printing system, an additional turning station—partly to replace the curved section 38 of the flip unit 32—is configured outside the print engine and control section 3 between the print engine and control section 3 and the output section 5.

When the print medium has to be printed in a simplex mode, the print medium may directly by transported via the flip unit 32 to the inlet 53 of the output section 5.

When the print medium has to be printed in a duplex mode, the print medium is transported via the flip unit 32 to the other paper path section 35 for turning the print medium in order to switch front side and back side of the sheets. The sheets are then transported to the paper path section 34 again for printing on the rear side of the sheets by means of the print head or print assembly 31.

The print engine and control section 3 also comprises an additional input holder 37 for holding print medium. Print medium may have to be input in the additional input holder 37 in a different orientation than an input orientation for the print medium holders 44, 45, 46.

The input section 4 comprises a plurality of print medium input holders 44, 45, 46 for holding the print medium before transporting the sheets of the print medium to the print engine and control section 3. Sheets of the print medium are guided from the print medium input holders 44, 45, 46 by guiding means 42, 43, 47 to an outlet 36, for entrance in the print engine and control section 3. Sheets of the print medium are now guided from the print medium input holders 44, 45, 46 to the right side of the print medium input holders 44, 45, 46, but other configurations of the print medium holders may be envisioned for at least partly guiding the sheets to the left side. For these other configurations, a suitable instruction for face up or face down loading of the print medium in the respective print medium input holder will be generated by the control unit.

FIG. 1 shows a plurality of print medium input holders. The invention, however, also applies to a printing system for only one print medium input holder.

FIG. 1 shows a plurality of print medium output holders. The invention, however, also applies to a printing system for only one print medium output holder.

Figure 2:
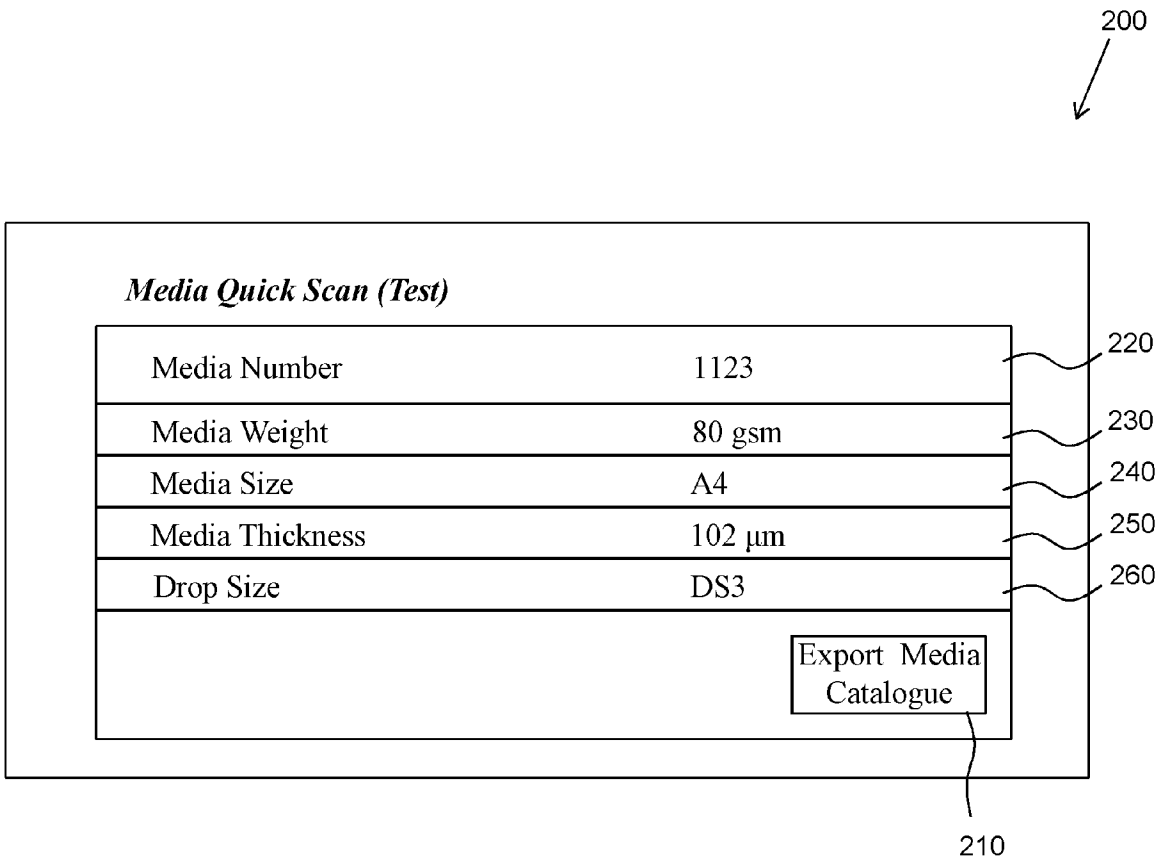
FIGS. 2 and 4 are examples of a window for a quick media scan according to the method of the invention.

FIG. 2 shows an example of a window 200 for a quick media scan according to the method of the invention. The window 200 may be part of tool software installed on an external mobile device or on the local user interface of the printing system 1.

When starting the method a provisional identification of the print medium is entered in a first entry field 220. Other ways of identifying the print medium to be approved may be envisioned and fall under the scope of the present invention. Print medium properties like media weight, media size and media thickness may be entered in the next entry fields 230, 240, 250 respectively. A media thickness and media weight may be collected from supplier specifications of the print medium. A drop size to be used when printing on the print medium under consideration may be entered in a separate entry field 260.

When the fields 220-260 are entered with values, a user operable item 210 may be activated in order to export the print medium properties to a media catalogue of the printing system 1, according to the invention.

The entry fields 220-260 are exemplary, other print medium properties may be envisioned and fall under the scope of the present invention. The entry fields 220-260 may be provided with selection lists, range lists, radio buttons, etc. For convenience reasons, the entry fields 220-260 are displayed in FIG. 2 in an utmost simple form.

Figure 3:
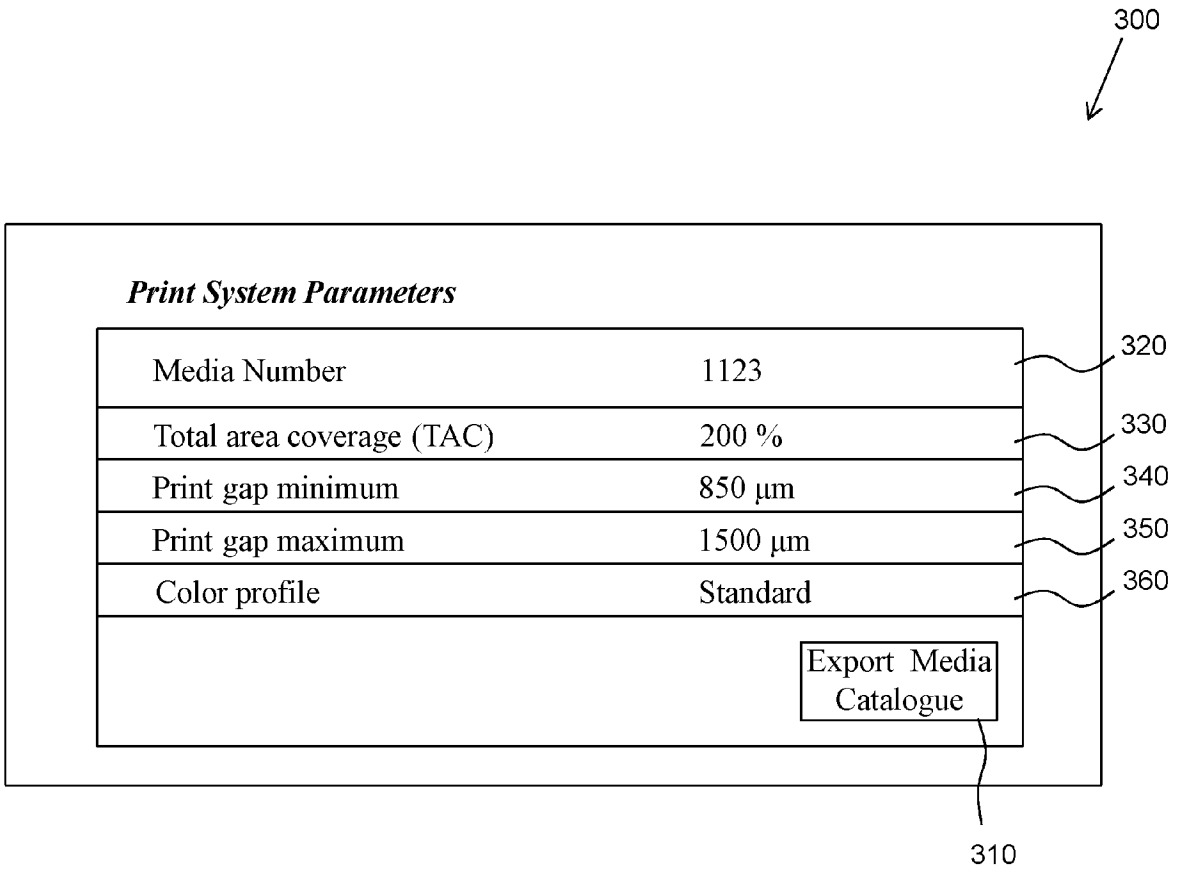
FIG. 3 shows a window of the local user interface of the printing system according to the invention.

In FIG. 3, an exemplary window 300 is shown, which is preferably implemented for display on the local user interface 7 of the printing system 1. The window 300 shows entry fields 330, 340, 350, 360 for print system parameters, which are relevant for an approval of a new print medium according to the invention. Initially shown values for the print system parameters in the entry fields 330-360 may be defaulted.

In order to link the values of the print system parameters 330-360 to the new print medium, an entry field 320 is introduced for entering a provisional identification of the new print medium. Steps a)-e) of the method according to the invention are performed until step f) is reached. The adjusted values of the print system parameters 330-360 are in this case TAC 200%, print gap minimum 850 μm, print gap maximum 1500 μm, and a standard color profile. Other color profiles may be envisioned for an uncoated print medium, a coated print medium, or a print medium with specific treatments for inkjet printing. A color profile is usually associated with a TAC value. The print gap minimum may be used to balance between a risk for paper crashes and streakiness on the printed print medium. The print gap maximum may be used to enable productive printing in a mixed print jobs using more than one print medium. The adjusted values of the print system parameters are exported to the entry of the new print medium in the media catalogue system by activating a user operable digital item 310.

The entry fields 320-360 are exemplary, other print system parameters may be envisioned and fall under the scope of the present invention. The entry fields 320-360 may be provided with selection lists, range lists, radio buttons, etc. For convenience reasons, the entry fields 320-360 are displayed in FIG. 3 in an utmost simple form.

As soon as the values of the entry fields 320-360 are exported to the media catalogue, the print medium is approved for use in the printing system 1.

Figure 4:
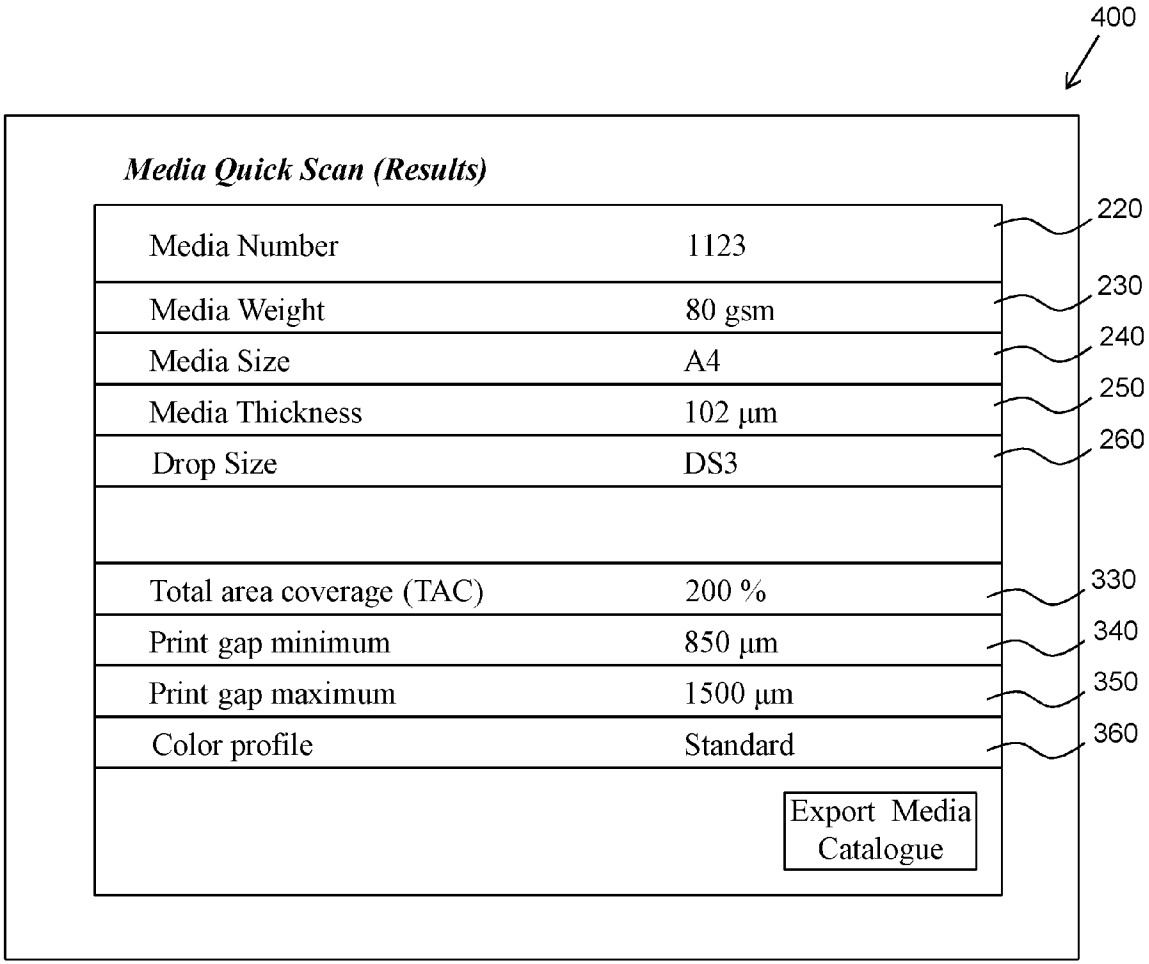

In FIG. 4, an exemplary window 400 is shown for display of values of the print medium properties of the approved print medium in combination with the adjusted values for the print system parameters for the approved print medium is shown. The window 400 may be part of tool software installed on an external mobile device or on the local user interface of the printing system 1. As soon as a print medium is approved, the values shown in FIG. 4 may be transferred from the media catalogue to storage of the external mobile device.

Figure 5:
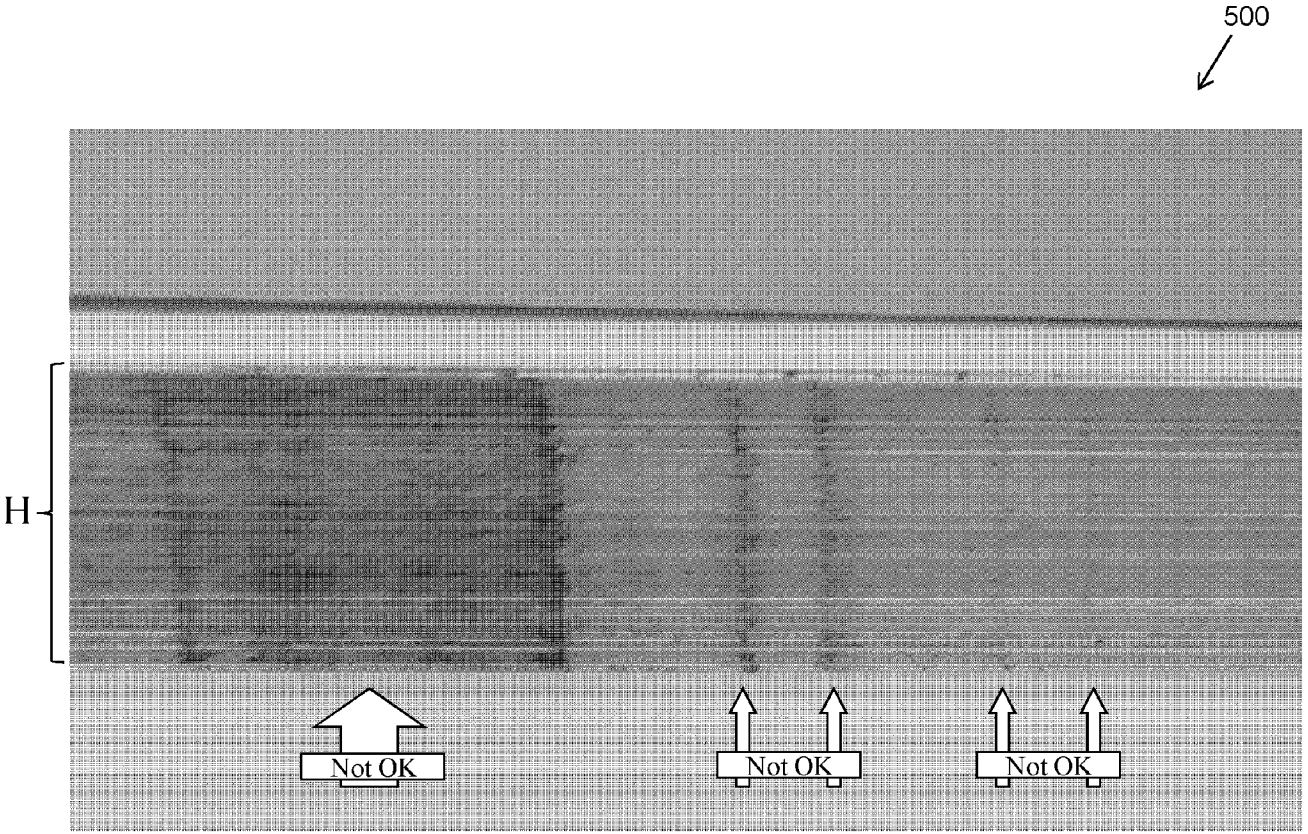
FIG. 5 shows pollution on a stack of sheets printed according to the method of the invention.

FIG. 5 shows a picture 500 of pollution on a stack height side of a stack of sheets printed according to the method of the invention. The stack of sheets has a stack height H. Pollution in the form of vertical smear stripes is visible on the stack height side and indicated by the arrows labelled "Not OK". The stack height side consists of same oriented edges of the sheets in the stack. For example, the left-sided edges of the sheets in the stack may form the stack height side, the right-sided edges of the sheets in the stack may form the stack height side, etc.

Figure 6:
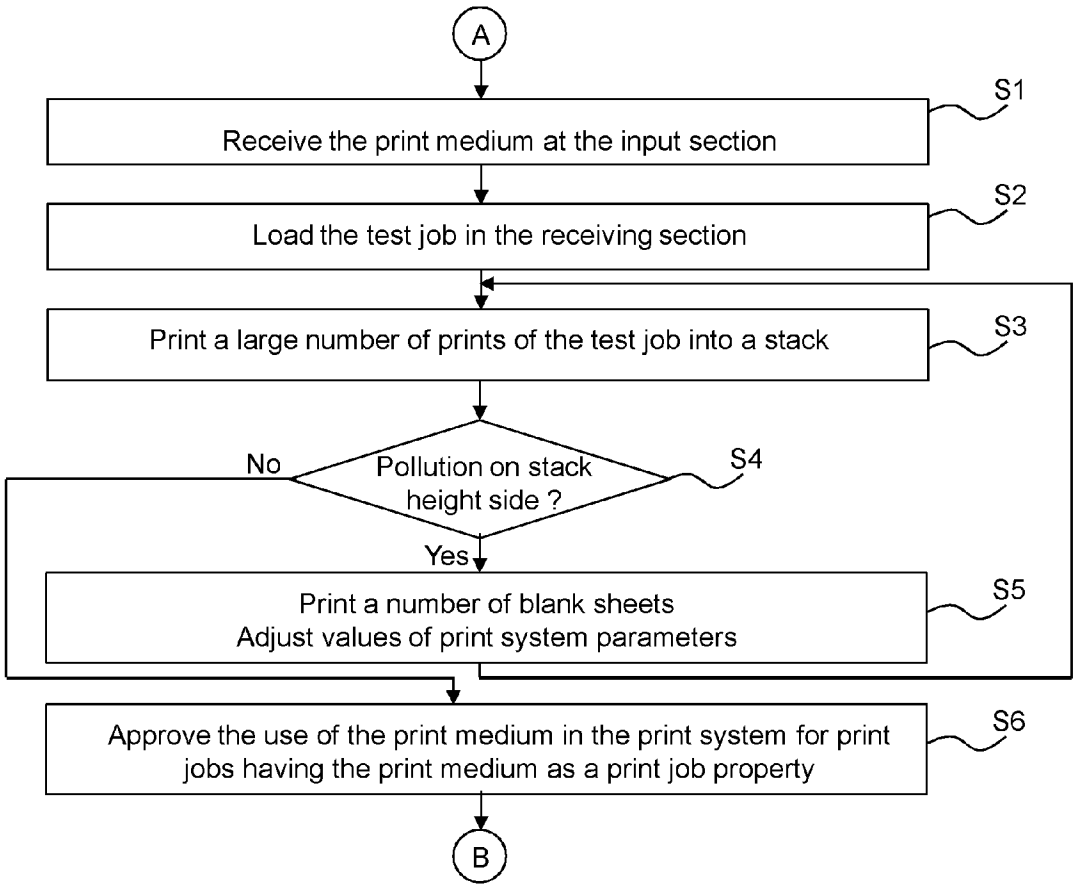
FIG. 6 is a flow diagram of an embodiment of the method according to the invention.

FIG. 6 shows a flow diagram of an embodiment of the method according to the invention.

The method starts in a starting point A and proceeds to a first step S1.

In the first step S1, the print medium is received at the input section of the printing system according to the invention.

In a second step S2, a test job is loaded in the receiving section of the print system according to the invention. The test job comprises an image suitable for testing prescribed values of the print system parameters. A print job property of the test job is the print medium to be approved.

In a third step S3, a large number of prints of the test job is printed such that a stack of the number of prints is sufficiently high to establish an unwanted deposit of marking material on the side of the stack.

In a fourth step S4, it is decided whether or not an unwanted marking material is deposited on a stack height side of the stack. The decision may be achieved by operator observation or by an automated scanning system for checking for pollution of the stack height side of the stack.

If an unwanted deposit of marking material is established on the stack height side, the method proceeds to a fifth step S5. If not, the method proceeds to a sixth step S6.

In the fifth step S5, a number of blank sheets of the same print medium are printed in order to clean the inside of the print engine. Also the print system parameters are adjusted.

For example, a TAC may be lowered in discrete steps of for example 10%, or a print gap maximum may be lowered. Other adjustments may be envisioned, such as a drop size adjustment, a print speed adjustment, another nozzle failure parameter setting, another print head transition parameter setting, another fixation or drying parameter setting, like an increase of a fixing temperature or an increase of a drying air flow, another paper handling parameter setting, another halftoning raster parameter setting, etc.

Then the method returns to the third step S3.

In the sixth step S6, if no unwanted deposit of marking material is established on the stack height side, the use of the print medium in the print system is approved for print jobs having the print medium as a print job property.

According to an alternative embodiment, before the sixth step S6 of approving the use of the print medium in the print system, the method comprises the step of loading blank sheets of the print medium in the tray upside down, and repeating the steps S3-S6 with the same print system parameters. In this way, it is achieved different medium properties of the front and back side of the sheets of the print medium are taken into account.

According to an alternative embodiment, the sixth step S6 comprises a sub-step of performing a standard media family calibration for the print medium to be approved.

The method ends in end point B.

Figure 7:
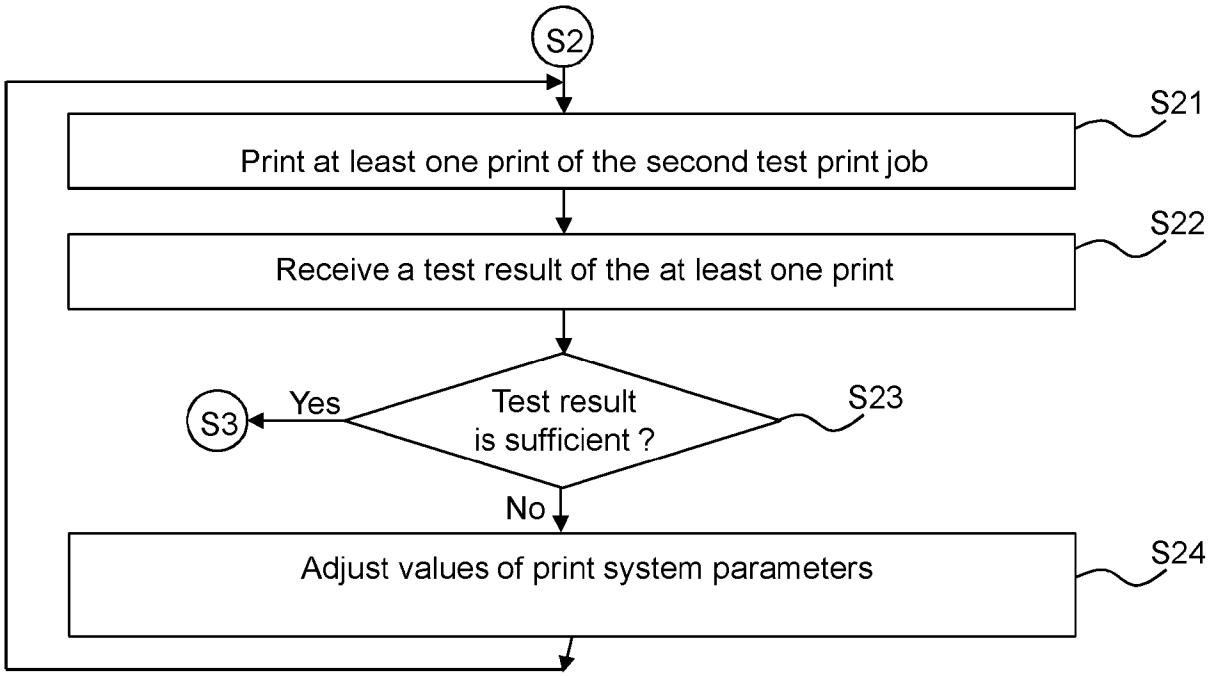
FIG. 7 is a flow diagram of a further embodiment of the method according to the invention.

FIG. 7 shows a flow diagram of a further embodiment of the method according to the invention. Steps S21, S22, S23 and S24 may be introduced in the first flow diagram in FIG. 6 directly after the execution of the second step S2.

In a first additional step S21, a second test print job submitted to the print system is received in the receiving section of the print system. At least one print of a second test job is printed. The second test job is designed to test an image quality of a print of the second test job.

In a second additional step S22, a test result of the at least one print printed in the first additional step S21 is received. The test result may be received by means of the local user interface of the print system or via a user interface of an external mobile device connected to the print system.

In a third additional step S23, it is decided if the image quality of the test result is sufficient. If the image quality of the test result is sufficient, the method proceeds with the third step S3 in FIG. 6. If not, the method proceeds to a fourth additional step S24.

In the fourth additional step S24, the print system parameters are adjusted.

For example, the TAC may be increased, the print gap minimum may be increased, and/or the color profile may be changed. Other adjustments may be envisioned, such as a drop size adjustment, a print speed adjustment, another nozzle failure parameter setting, another print head transition parameter setting, another fixation or drying parameter setting, like an increase of a fixing temperature or an increase of a drying air flow, another paper handling parameter setting, another halftoning raster parameter setting, etc.

Then the method returns to the first additional step S21.

The present invention being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for adding a print medium digitally to a print system, the print system being configured to print on approved print media and comprising a control unit for controlling print system parameters to be applied when printing on the print medium, a print engine for printing marking material on the print medium, an input section for receiving the print medium in the print system, and a receiving section for receiving print jobs submitted to the print system, the method comprising the steps of:

a) receiving the print medium in the input section;

b) loading a test job in the receiving section, the test job comprising as a print job property the print medium with prescribed print system parameters;

c) printing a large number of prints of the test job such that a stack of the number of prints is sufficiently high to establish an unwanted deposit of marking material on a stack height side of the stack by operator observation or by an automated scanning system for checking pollution of the stack height side of the stack;

d) establishing whether or not an unwanted marking material is deposited on the stack height side of the stack;

e) if an unwanted deposit of marking material is established on the stack height side:

printing a number of blank sheets of the same print medium;

adjusting the print system parameters; and returning to step c); and f) if no unwanted deposit of marking material is established on the stack height side, approving the use of the print medium in the print system for print jobs having the print medium as a print job property.

2. The method according to claim 1, further comprising the steps of:

g) printing at least one print of a second test job, the second test job designed to test an image quality of a print of the second test job;

h) receiving a test result of the at least one print printed in step g);

i) if the image quality of the test result is sufficient, proceeding with step c); and j) if the image quality of the test result is not sufficient, adjusting print system parameters and returning to step g), wherein the steps g)-j) are performed after step b) and before step c).

3. The method according to claim 1, wherein the print system further comprises a print medium catalogue for print media to be used in the print system, and step f) of approving the use of the tested print medium further comprises the steps of:

k) creating a new entry in the print medium catalogue for the tested print medium;

l) adding properties of the tested print medium to the entry; and m) adding the adjusted print system parameters to the entry.

4. The method according to claim 3, further comprising the steps of:

n) creating a first media catalogue entry for the print medium with properties of the medium and with default print system parameters;

o) creating a second media catalogue entry for the print medium for testing the test job in which the print medium is used with prescribed print system parameters;

p) adjusting the print system parameters in the second media catalogue entry due to step e); and q) approving the print medium by adding properties of the print medium to the second media catalogue entry, by replacing the first media catalogue entry by the second media catalogue entry, and by removing the second media catalogue entry from the media catalogue.

5. The method according to claim 1, wherein the print system parameters comprise at least one of a total area coverage value, a print gap minimum distance, a print gap maximum distance, a color profile, a print speed, a dot size, a print head transition setting, a nozzle failure correction setting, a fixation setting, a drying setting, a paper handling setting and a halftoning raster setting.

6. The method according to claim 1, wherein each of the blank sheets have an upside and a downside, wherein the upside has different properties than the downside, and wherein before approving the use of the print medium in the print system, the method comprises the step of loading blank sheets of the print medium upside down in the input section and repeating the steps c)-f).

7. The method according to claim 1, wherein before approving the use of the print medium in the print system, the method comprises the step of performing a standard media family calibration for the print medium to be approved.

8. A printing system configured to print on print media and comprising:

a control unit for controlling print system parameters to be applied when printing on the print medium;

a print engine for printing marking material on the print medium;

an input section for receiving the print medium in the print system; and a receiving section for receiving print jobs submitted to the print system, wherein the control unit is configured to execute the method of claim 1.

9. A non-transitory computer readable medium comprising computer executable program code configured to perform the method according to claim 1.

* * * * *